US010482733B2

(12) United States Patent
Dobbins et al.

(10) Patent No.: US 10,482,733 B2
(45) Date of Patent: Nov. 19, 2019

(54) MOBILE VALUABLES TRANSPORT SYSTEM WITH TAMPERING TRIGGERED SMOKE DEPLOYMENT

(71) Applicant: Ellenby Technologies, Inc., Woodbury Heights, NJ (US)

(72) Inventors: Aaron H. Dobbins, Cherry Hill, NJ (US); James M. Henry, Marlton, NJ (US); Jeffrey D. Welder, Voorhees, NJ (US); Brian D. Stang, Bel Air, MD (US)

(73) Assignee: ELLENBY TECHNOLOGIES, INC., Woodbury Heights, NJ (US)

( * ) Notice: Subject to any disclaimer, the term of this patent is extended or adjusted under 35 U.S.C. 154(b) by 0 days.

(21) Appl. No.: 15/962,186

(22) Filed: Apr. 25, 2018

(65) Prior Publication Data

US 2018/0308327 A1 Oct. 25, 2018

Related U.S. Application Data

(60) Provisional application No. 62/489,746, filed on Apr. 25, 2017.

(51) Int. Cl.

| | |
|---|---|
| ***G08B 13/06*** | (2006.01) |
| ***G08B 3/10*** | (2006.01) |
| ***G08B 15/02*** | (2006.01) |
| ***G08B 13/14*** | (2006.01) |

(52) U.S. Cl.

CPC ..... *G08B 13/06* (2013.01); *G08B 3/10* (2013.01); *G08B 13/1427* (2013.01); *G08B 15/02* (2013.01)

(58) Field of Classification Search

CPC ..... H04W 4/00; H04L 1/00

See application file for complete search history.

(56) References Cited

U.S. PATENT DOCUMENTS

| | | | | |
|---|---|---|---|---|
| 5,748,089 | A | 5/1998 | Sizemore | |
| 5,790,028 | A | 8/1998 | Lee | |
| 6,029,482 | A | 2/2000 | Rifkin | |
| 7,707,950 | B2 | 5/2010 | Villiger | |
| 8,781,397 | B2 | 7/2014 | Sole | |
| 9,113,518 | B2 | 8/2015 | Dobbins | |
| 2017/0166163 | A1* | 6/2017 | Poma | G07C 9/00174 |
| 2018/0157610 | A1* | 6/2018 | Chan | G06F 13/385 |

FOREIGN PATENT DOCUMENTS

| | | | |
|---|---|---|---|
| EP | 2347078 | A1 | 7/2011 |
| EP | 2510506 | A1 | 10/2012 |
| WO | WO2010055327 | A1 | 5/2010 |
| WO | WO2011069803 | A1 | 6/2011 |

* cited by examiner

*Primary Examiner* — Shirley Lu

(74) *Attorney, Agent, or Firm* — Hultquist, PLLC; Peter H. Priest

(57) ABSTRACT

Cash transport bag tampering detection and controlled triggering of smoke dispenser in response to said detection. Additionally, techniques are addressed to pair a cash transport bag with a user fob or user fobs in response to a pairing control signal from a supervisory fob. With a cash transport bag having a zipper closure, techniques to issue proper zipper closure and detection of such closure are also addressed.

19 Claims, 14 Drawing Sheets

MOBILE VALUABLES TRANSPORT SYSTEM WITH TAMPERING TRIGGERED SMOKE DEPLOYMENT

This application claims the benefit under 35 USC § 119 of U.S. Provisional Patent Application Ser. No. 62/489,746 entitled "Mobile Cash Transport System With Tampering Triggered Smoker Deployment" filed Apr. 25, 2017 and incorporated by reference herein in its entirety.

The present application is related to U.S. Pat. No. 9,406,208 entitled "Mobile Cash Transport System with Tampering Triggered Ink Deployment" and U.S. patent application Ser. No. 14/302,555 entitled "Method and Apparatus for Mobile Cash Transportation" filed on Jun. 12, 2014 both assigned to the assignee of the present application and both of which are incorporated by reference herein in their entirety.

FIELD OF THE INVENTION

The present invention relates generally to improved methods and apparatus for mobile storage and transportation of cash or other valuable assets. More particularly, the present invention relates to advantageous aspects of an improved transport bag with tampering or theft countermeasures, such as triggered smoke deployment, a siren, or the like and retrofit systems for modifying existing asset transport bags and the like.

BACKGROUND OF THE INVENTION

There are a number of risks faced by those that are required to transport valuables from one place to another, such as from a business to a place of safe keeping, for example. A primary risk is that of robbery of those valuables while in transit. A secondary risk is that of theft by a courier given the task of transporting the valuables. Several approaches have been taken to reduce such risks, but these approaches are often costly and excessively complex.

In one prior art approach, relatively large and complicated portable cases have been designed to protect valuables. Such cases feature formidable physical security and tamper monitoring systems. European Patent Nos. 2,347,078 and 2,510,506 teach transport cases that feature a dispensing system and electronic monitoring system that are designed to devalue cash inside with a devaluing agent such as glue (2,347,078) or ink (2,510,506) when the transport case is tampered with. Another transport system is taught by Villiger in U.S. Pat. No. 7,707,950. This system is large in physical size and weight to support an elaborate dispensing system. The complexity and size of such approaches make them costly.

In an alternative approach, smaller cases have been created that reduce the cost, complexity, and weight of devaluing agents designed for 100% coverage of cash stored within and instead focus on generating attention in the event of a robbery. Several such products use loud sirens and can be configured to release smoke or dye inside the case to partially stain the contents and the robber. The tamper detection methods used tend to be simpler than the large products addressed above and typically involve the use of panic buttons and or tethered pull cords.

In one such example, a transport bag apparatus that incorporates a staining agent to mark cash stored within, but not necessarily to the level of destruction or devaluing is addressed in U.S. Pat. No. 5,790,028. This patent also includes a high voltage generator for the purpose of electrically shocking a robber, and a siren to draw attention, as well as, a mechanism for remote wireless activation of these countermeasures in response to an attempted theft.

Another example is a portable personal security system as taught by U.S. Pat. No. 5,748,089 in which a smoke or sparkler device is ported intentionally outside of a transport bag for the purpose of grabbing attention and alarming a robber rather than staining contents inside the bag.

These types of systems may require that the custodian manually deploy the countermeasures by pushing a panic button or switch or otherwise rely on rip cords or breakaway features to set off the alarm. In a snatch and run robbery, the custodian may not have time to realize the attempted theft is taking place and manually activate the alarm feature. Rip cords and break away features are also prone to false activation causing unnecessary public distress and costly smoke replacement. These systems also fail to monitor whether the bag itself is actually securely closed.

U.S. Pat. No. 6,029,448 proposes a method for monitoring whether security bags are securely locked by monitoring the state of a specially designed zipper lock mechanism. This patent teaches a method of combining a standard zipper lock with a circuit board for the purpose of monitoring lock closures. The standard style of zipper lock described has the limitation of needing to be sized precisely to fit a particular zipper housing body. A second limitation of this approach is it requires carefully backing the zipper body into the lock housing prior to pressing down on the zipper lock capture mechanism. If alignment of the zipper body is not proper, the zipper lock will not engage and the bag will not be secured.

Some of the recent systems use wireless radios to monitor the proximity of the case to a transporter, such as a guard, and are configured to deploy when the case gets too far from the guard. Examples of these types of system are produced by HDH Security Systems, Ltd. and in particular include their Proximity Case™ model. Such systems suffer from employing a method of pairing the case to a guard's key fob that are complicated to perform or are not supportive of simple reassignment to other guard fobs as would be helpful in a deployment of secure cases in a fleet of users. They also lack the ability to track whether the case is securely closed and locked and to keep track of which guard has maintained custody of the case.

SUMMARY OF INVENTION

Among its several aspects, the present invention provides an improved mobile valuables transport system that advantageously uses advanced, cost-effective tamper detection techniques combined with a smoke and siren system that can be configured to a wide range of bags including those optimally suited for armored car companies and that address a simple method of configuring bags to guards, other couriers, or the like.

It is one objective of the present invention to provide an electronically monitored transport bag system wherein each bag is characterized by having a wireless radio interface that is in communication with a guard's fob. The fob is securely and uniquely paired to the transport bag. The bag is deemed under control of the guard when the fob is determined to be within a first predetermined distance. Once deemed outside of the guard's control, the bag security system is configured to deploy theft countermeasures, such as a loud siren and or smoke for the purpose of generating attention and compelling a thief to stop a robbery.

Another objective is to provide an arrangement of tamper detection electronics and a power source within a plastic module mounted to one wall of a valuables containing bag with at least one port that vents smoke and emits sound outside the bag.

It is a further objective to provide a two piece security module with an interior piece fastened inside a valuables containing bag and an external piece fastened outside the bag. The external piece contains a smoke pack and siren with vents to direct the smoke and sound release. The internal piece contains tamper electronics and a power source. The two pieces are connected with an electrical linkage carrying power and data signals and may be mechanically connected with either rigid fasteners through the bag wall or a fastener that wraps around the zipper opening of the bag.

It is another aspect of the invention to provide a method of securing a zipper fastener, such as a zipper body, and electronically detecting that the zipper lock is engaged.

It is a further objective to provide a unique and a secure pairing method to associate a fob with a bag. In one approach, this pairing can only occur when assisted by a separate pairing device without the use of a pairing button on or in the bag itself. The pairing device can be in the form of a radio communicating using the same spectrum as the fob or in the form of an alternate out of band radio.

It is another objective to provide a method of operating a bag with multiple authorized guards simultaneously.

It is another objective to provide a tamper detection system for a bag containing valuables that combines an ambient light sensor configured to look inside a normally dark bag, a zipper lock detector, and a fob proximity detector as addressed further herein.

It is yet another objective to provide a method of ensuring a zipper bag is closed and locked using a magnetic field sensing approach and permanent magnets mounted on both the zipper body and lock armature.

It is another objective to describe a bag security system within a single rigid module combining a zipper lock, a siren, a smoke emitting device, a wireless radio, a battery power source, and a display.

To such ends, the present invention provides advantageous mechanisms to detect efforts to open a cash transport bag after it has been closed by an authorized person and to trigger a smoke dispenser in response to such detection. The present invention may be suitably applied to both newly manufactured cash transport bags, as well as, being adapted as a retrofit to a wide variety of existing bags.

A more complete understanding of the present invention, as well as, further features and advantages of the invention, will be apparent from the following discussion and the drawings included therein.

DETAILED DESCRIPTION

Figure 1:
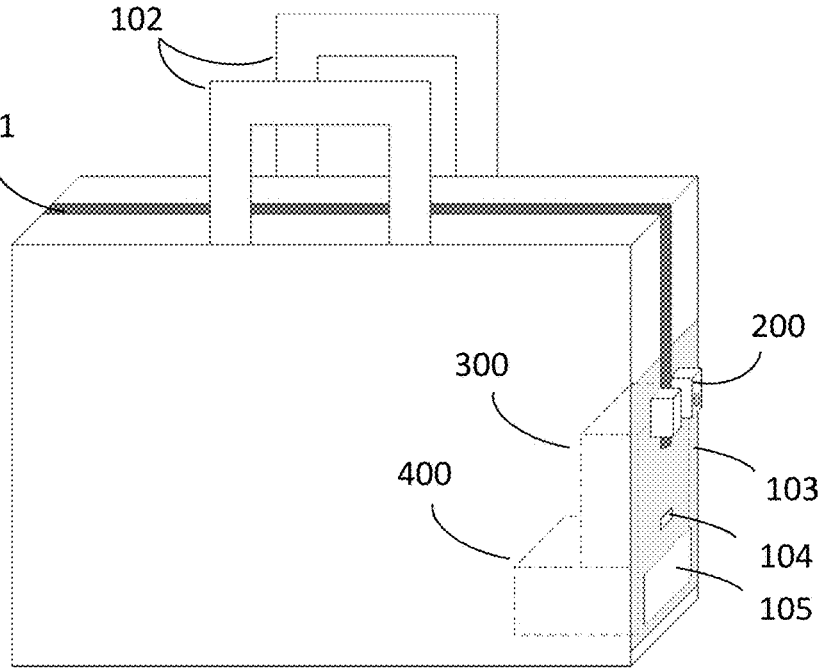
FIG. 1 is an overview of a smart transport bag (STB) in accordance with a first embodiment of the invention.

In FIG. 1, a smart transport bag (STB) 100 in accordance with a first embodiment of the invention may suitably be approximately 20" wide by 20" tall by 7" deep. The STB 100 is typically made from a durable fabric, such as nylon, vinyl, canvas or a combination of these materials and is opened and closed with a zipper. It has a pair of handles 102 on either side. A front panel 103 has a controller module 300 and an alarm module 400 mounted internal to the STB 100. An opening 104 is cut through front panel 103 to expose a user interface display from the controller module. A second opening 105 is cut in front panel 103 to allow sound, smoke, and or strobe lighting to escape from the alarm module 400 as addressed further below. A zipper lock system 200 is located proximate to the control module 300 and is configured to trap the body of a zipper 220 that rides along zipper track 230 pulling the zipper teeth together.

Figure 2:
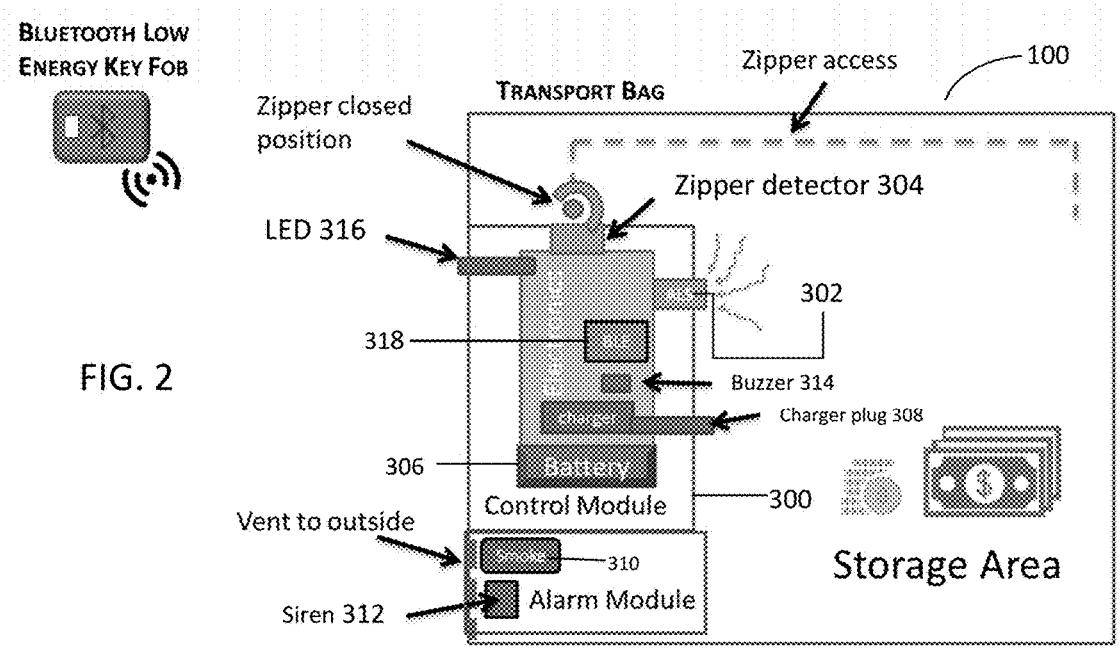
FIG. 2 is a functional illustration of operational details of the STB of FIG. 1.
Figure 4:
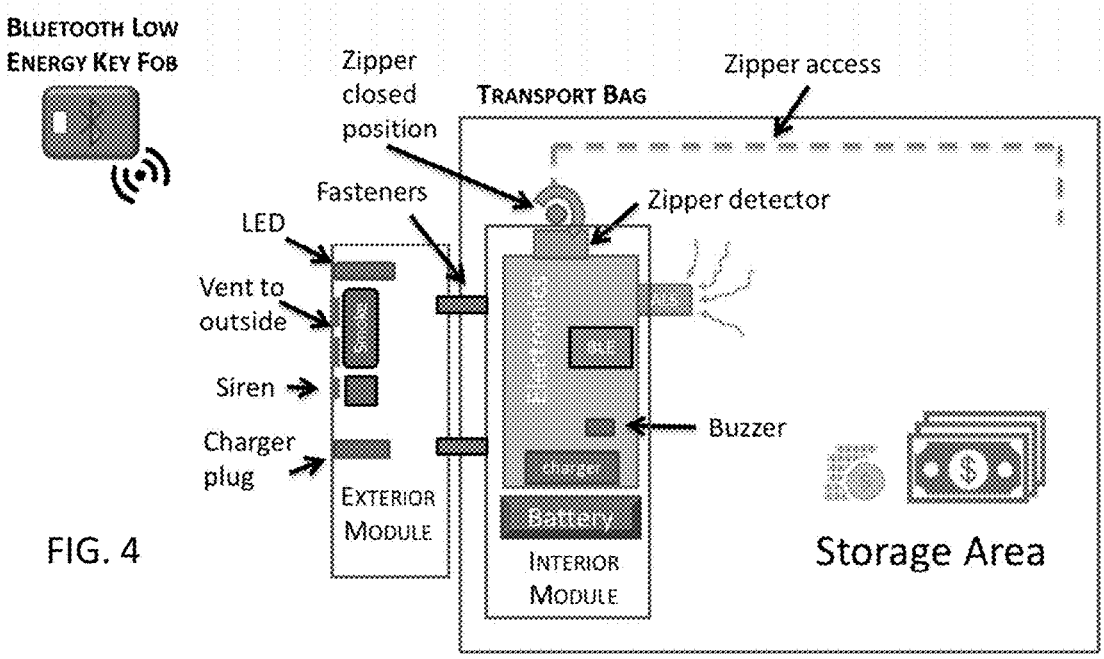
FIG. 4 shows aspects of an STB in accordance with a third embodiment of the invention.
Figure 5:
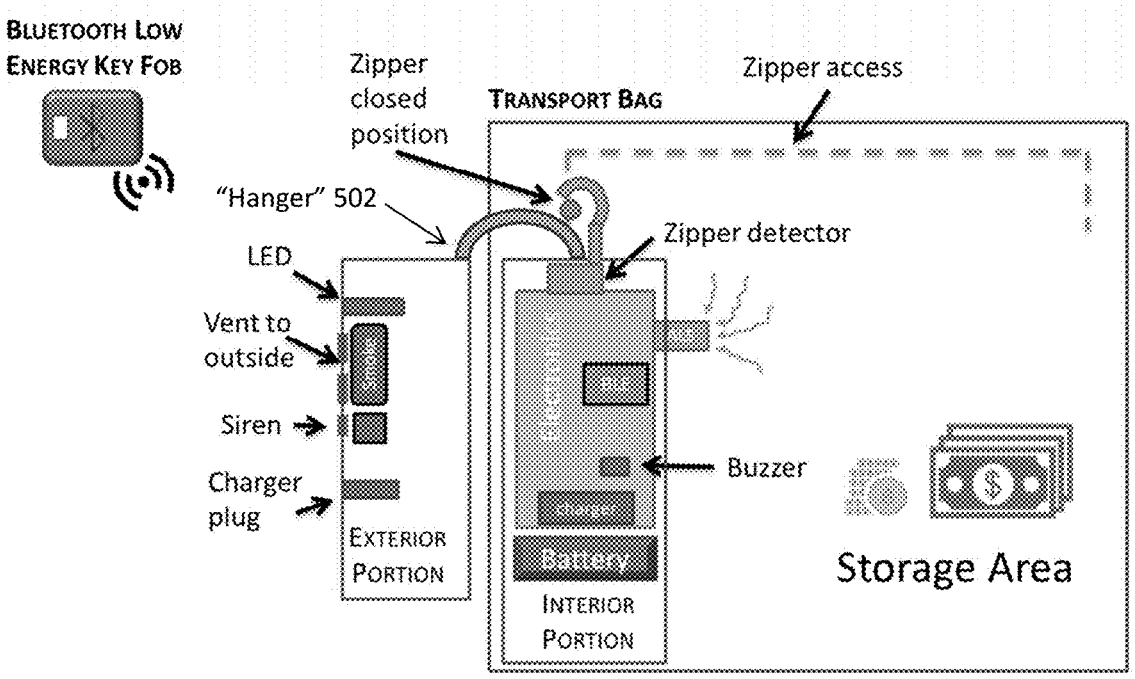
FIG. 5 illustrates an STB in accordance with a fourth embodiment of the invention.
Figure 6:
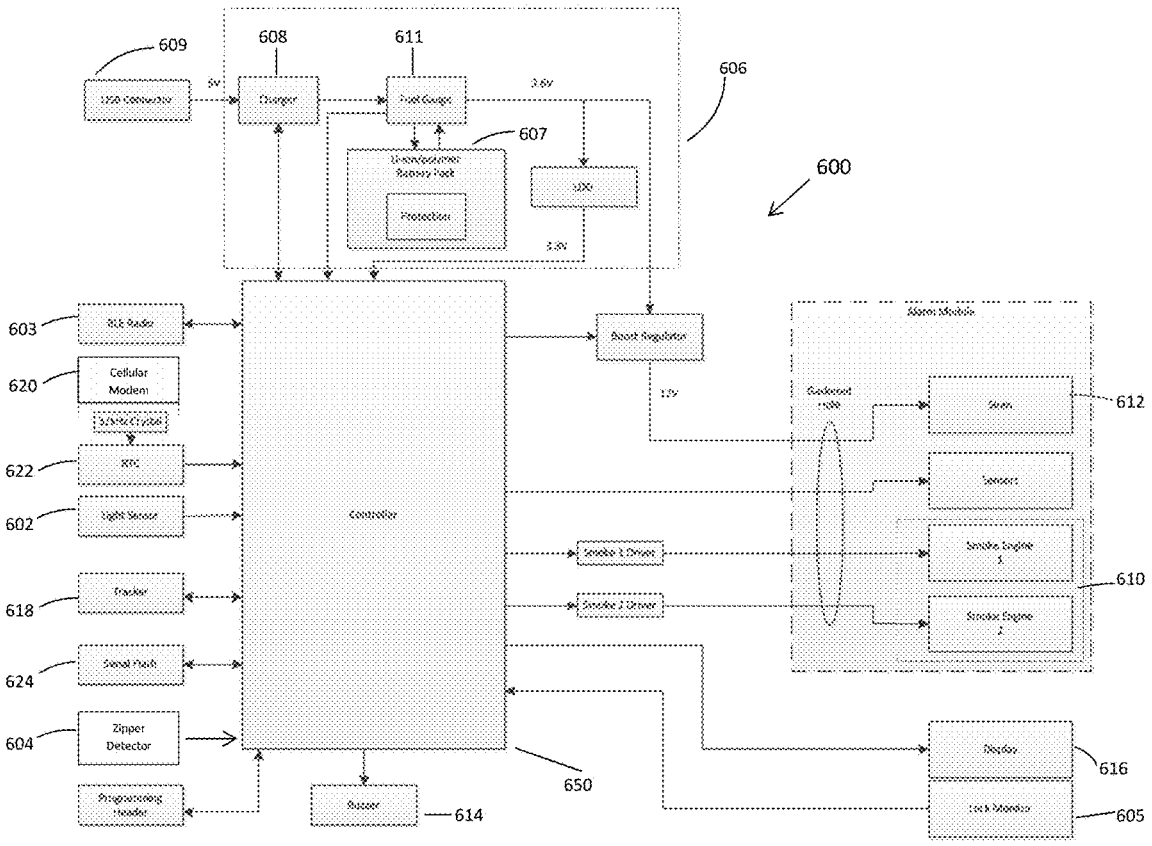
FIG. 6 is a system diagram illustrating aspects of control electronics which may suitably employed within smart transport bags in accordance with the present invention.
Figure 21:
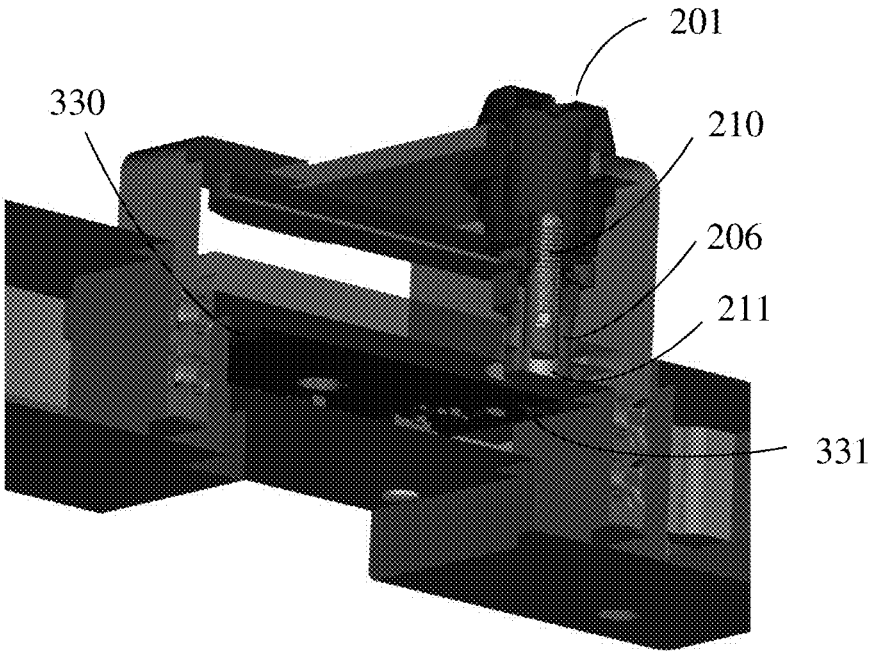
FIG. 21 is a cutaway view of the zipper lock mechanism of FIG. 19.
Figure 22:
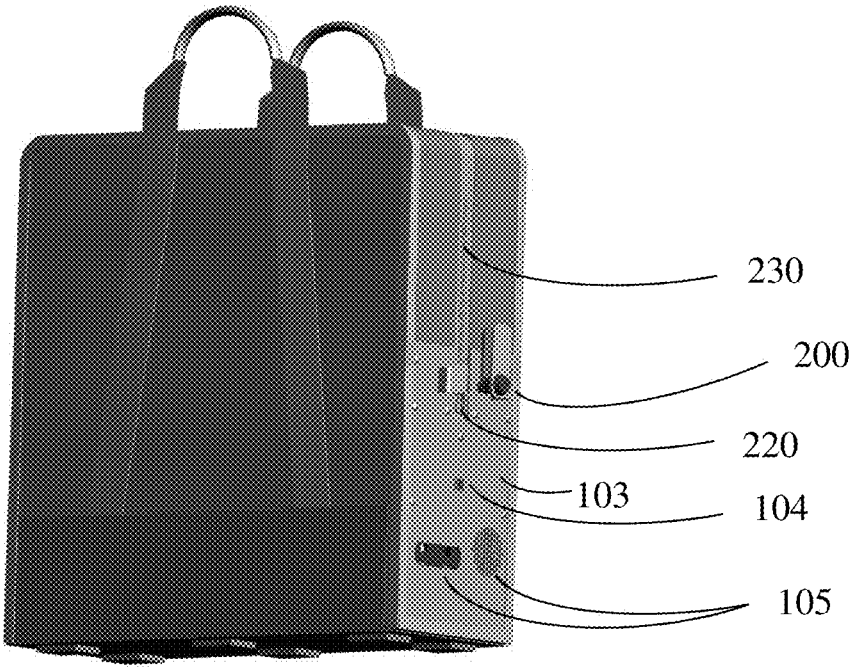
FIG. 22 shows a model of the preferred embodiment of the STB in the zipped closed and unlocked state.
Figure 23:
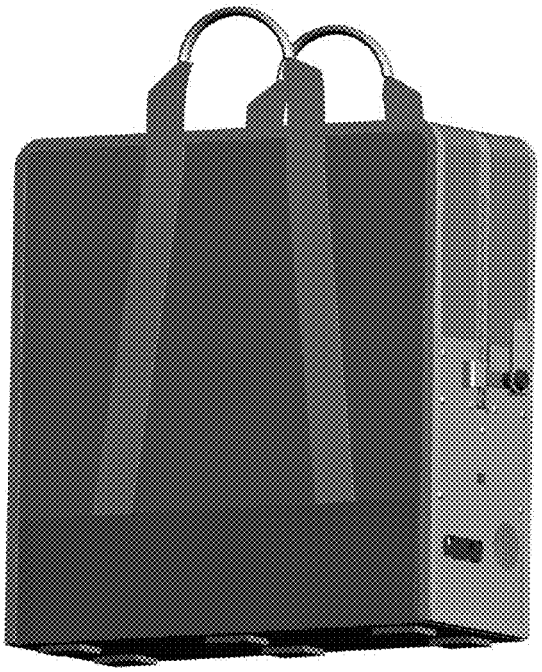
FIG. 23 shows a model of the preferred embodiment of the STB in the zipped closed and locked state.

Operational details of a first and presently preferred embodiment of the invention are summarized in conjunction with a discussion of FIG. 2 and can be better understood in combination with the block diagram of control electronics 600 shown in FIG. 6 suitable for use in the control modules of FIGS. 2-5. The control electronics 600 perform the tasks of receiving and transmitting wireless communications to a key fob device 500, preferably using a Bluetooth low energy (BLE) communication radio 603. Other wireless protocols can be used including Zigbee, WiFi, or cellular, for instance. The control electronics 600 also include a tamper detector, in this case an ambient light sensor (ALS) 602 facing the inside darkness of a zipped-closed transport bag 100. If the ambient light inside transport bag 100 increases above a threshold when a thief cuts through the bag 100, ALS 602 will detect the change and trigger an alarm as addressed further below. Such tamper detection can also include an accelerometer for the purpose of monitoring bag orientation, drop sensing, and or abrupt, strong accelerations associated with forceful entry. A zipper detector 604 and lock monitor 605 are employed to monitor whether the zipper is fully zipped closed. In a presently preferred embodiment, a lock position detector 331 shown in FIG. 21 and discussed in greater detail below is used to determine if the zipper is locked or not. There is also a power source 606 and charge mechanism 608, preferably implemented using a 3.7V lithium ion rechargeable battery pack 607 and USB charge utilizing a USB connector 609, respectively. Battery power level is monitored with a fuel gauge circuit 611. Circuit 611 tracks current flow into and out of the battery pack to provide a precise measure of power remaining. This battery arrangement is suitable for use as battery 306 in FIG. 2. A smoke pack 610 and siren 612 are vented outside the bag. In FIG. 1, the smoke pack and siren are shown together with the control module 300, but preferably may be arranged in a separate housing.

One user feedback method involves the use of a buzzer 614 and display 616. The display is preferably an OLED graphic display but may also be implemented as standard discrete LEDs, a 7 segment display, LCD display, or vacuum florescent display.

FIG. 6, illustrates further aspects of presently preferred electrical control circuitry 600, such as a GPS tracker 618 and a cellular modem 620 for the purpose of transmitting location data of the STB back to a monitoring service. There is also a real time clock (RTC) 622 for recording precise times of the various logged activities such as arming or disarming the STB and the geographic position of the STB at various points in time. Logged time-stamped data is stored in a serial flash chip 624 proximate the controller 650.

Figure 11:
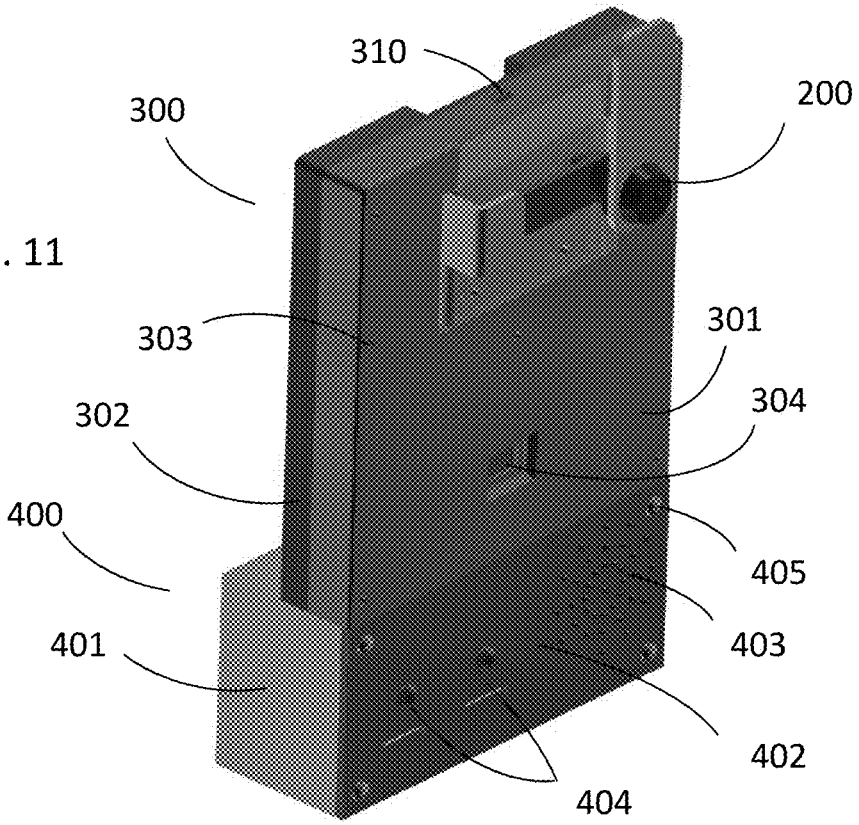
FIG. 11 illustrates an electronics package and zipper lock combination in accordance with the present invention.
Figure 12:
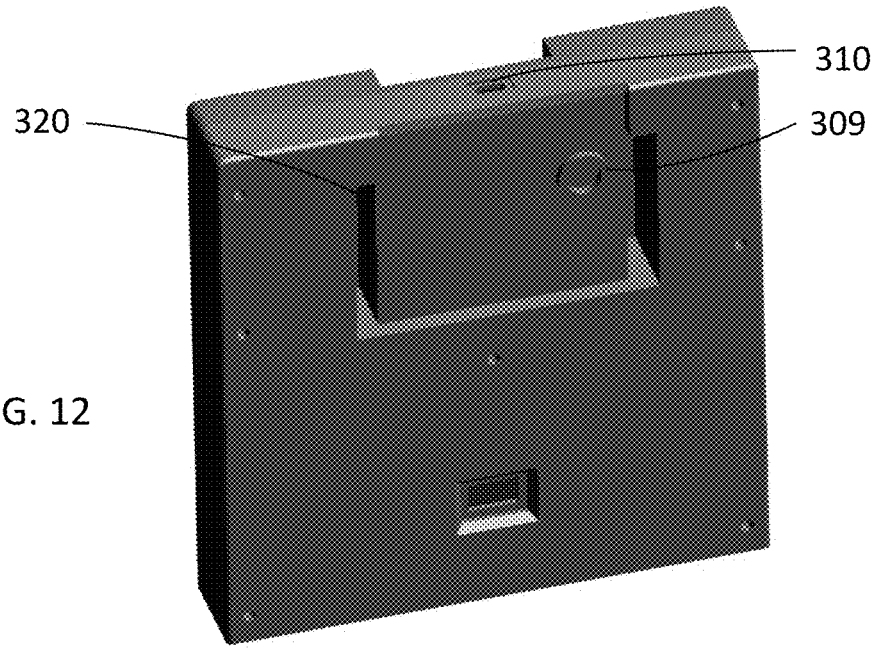
FIG. 12 illustrates a controller module suitably used in conjunction with STBs in accordance with the present invention.
Figure 13:
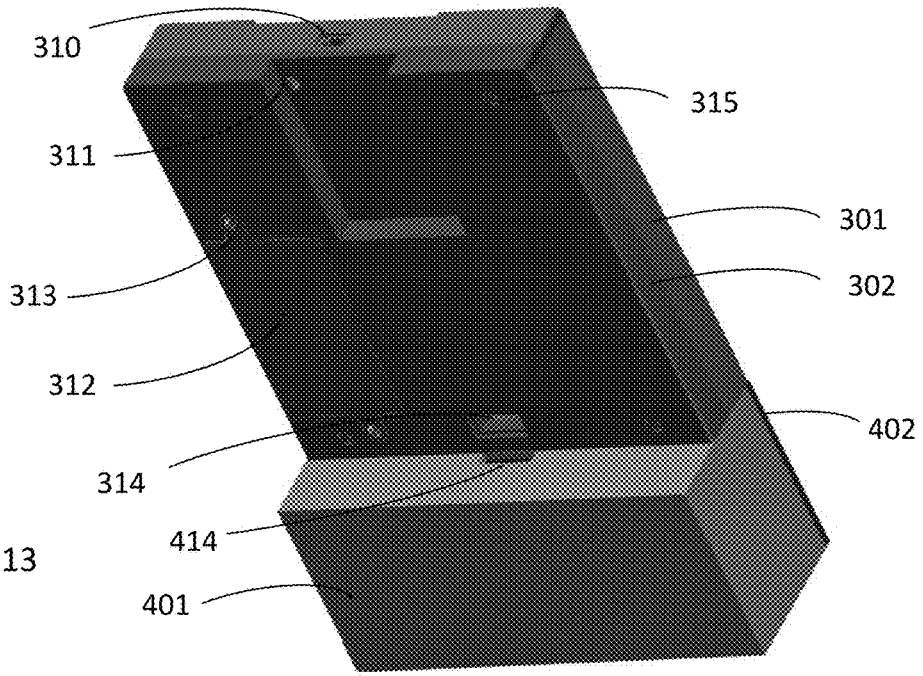
FIG. 13 is a rear view of the controller module of FIG. 12 and an alarm module with a mounting bracket that connects the controller and alarm hidden from external view.

Further mechanical design details of the presently preferred embodiment of the invention are shown in FIGS. 11-21. As shown in FIGS. 11-13, the control module 300 consists of a front shell enclosure 301 and rear shell enclosure 302 preferably fabricated with injection molded plastic. The front shell contains a hole 304 in which a clear window is inserted to allow a view for a display such as the aforementioned OLED graphic display. A second hole 310 serves as an opening for a battery charge plug, preferably a USB—C type or similar, to recharge the lithium ion battery. A series of screw bosses 303 are arranged around the perimeter for the purpose of affixing the enclosure 300 to the fabric panel 103 (FIG. 1) on the STB 100. Lock channel features 320 are located in the front enclosure 301 as seen in FIG. 12 for the purpose of locating a zipper lock bracket 205 seen in FIG. 18.

A lock axle capture feature 309 is designed to ensure the axle of lock 201 will rotate in a precise defined region over the lid 301 thereby confining the rotation motion to over the top of a rotation sensor located on circuit board 330. The axle of the lock is extended towards the front shell enclosure 301 by attaching a magnet holder cap 206 seen in FIG. 21 attached to the cam lock by threading a set screw 210 from the holder cap to the lock cylinder of cam lock 201. A diametrically magnetized magnet 211 is then affixed to the magnet holder cap 206. The magnet holder cap 206 is preferably made of plastic and magnet 211 is preferably neodymium. Diametric magnetization allows for a 2-axis magnetometer to measure the angle of rotation of the magnet from some defined starting orientation. Using a 3-axis magnetometer allows for a more direct field strength measurement to be made along the lock axle direction and is useful in determining how closely the magnet is positioned with respect to the underlying magnetometer detector 331 located on board 330 in line with the magnet.

A second magnet placed on the bottom of the zipper pull body can be used to determine that when locked, the zipper body is in the proper position behind the locking cam 203. The field from the zipper body magnet will deviate the measured readings on the magnetometer detector 331 in a predictable manner such that the presence or absence of the zipper can be inferred. For this enhancement, it is necessary to either slot an opening in the metal zipper back plate 205 below the zipper pull body such that the magnetic field lines can pass through to the detector or to use a stiff plastic material transparent to magnetic field lines in place of metal for the back plate. Alternatively, a separate magnetic field sensor, such as a multi-axis magnetometer, Hall sensor, or a reed switch could be used to detect the presence of the zipper pull itself independent from the one used for detecting the lock orientation to simplify the controller signal processing.

Figure 18:
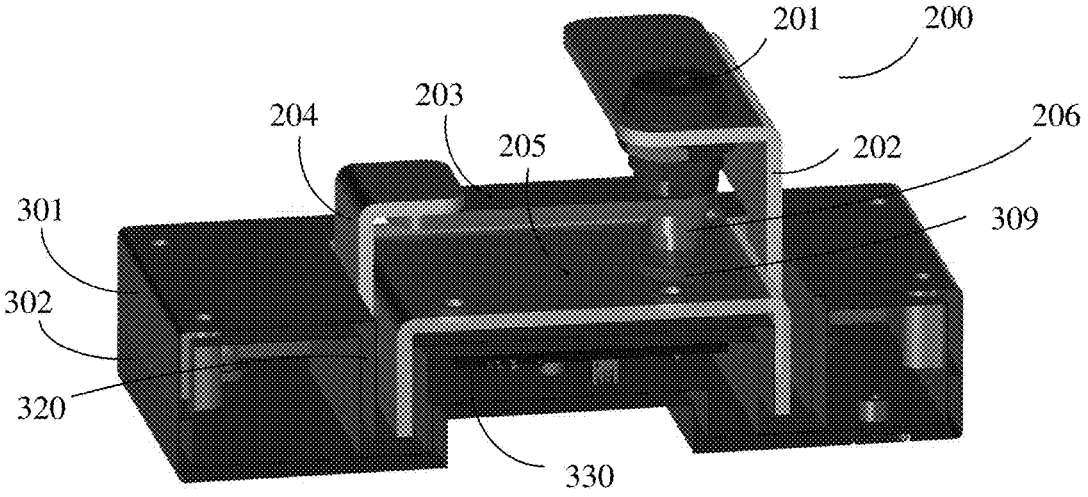
FIG. 18 is a view of a zipper lock mechanism shown from above with cross-section detail of mounting bracketry.
Figure 19:
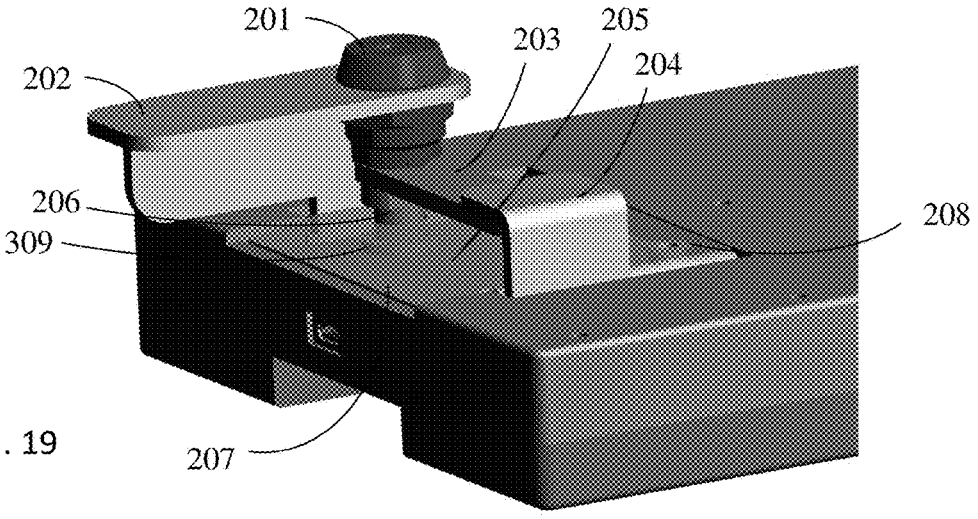
FIG. 19 is a side view of a zipper lock mechanism in a locked orientation.
Figure 20:
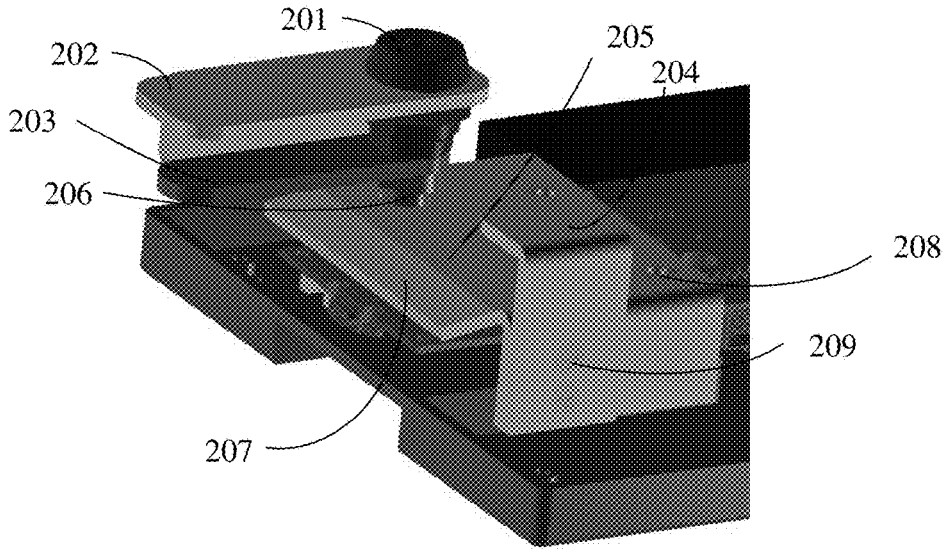
FIG. 20 is a side view of the zipper lock mechanism of FIG. 19 in an unlocked orientation with front enclosure cover hidden for clarity.

As shown in FIG. 18, a zipper lock assembly 200 consists of a lock mounting bracket 202 with a double "D" mounting hole designed to capture cam lock 201. Lock 201 contains cam 203 and is configured to swing 90 degrees from an unlocked position where the cam sits underneath the overhang of lock mounting bracket 202 as shown in FIG. 20, to a locked position where the cam sits underneath a retention bracket 204 as shown in FIG. 19. Both brackets are mounted to zipper back plate 205 fastened by two screws 209 each. The brackets overlap is best seen in FIG. 20 with the front enclosure housing hidden. The zipper back plate 205 is affixed to the bag's front fabric panel 103 as seen in FIG. 1 using two security screws through the fabric material and into the two metal screw bosses 208 shown in FIG. 19 which are preferably PEM® nuts pressed into the zipper back plate. The zipper back plate 205 sits underneath the zipper body when the bag is zipped all the way closed. It serves as a rigid back support for the body of the zipper such that the zipper is trapped between back plate 208 and metal cam 203. Ramp feature 207 on the back plate 208 ensures that the zipper smoothly ramps up on top of the plate when the bag is zipped.

The rear of the control module enclosure 302, as shown in FIG. 13, contains a hole 311 filled with a light pipe for the purpose of collecting ambient light from inside the bag and directing that collected light towards an ambient light sensor 602 located below the light pipe on circuit board 330. A second opening 314 is located near the bottom of this rear enclosure which allows a cable harness to exit the control module 300 and to pass into the alarm module 400 via hole 414 for the purpose of carrying power and control, and or communication signals. Access door 312 is held down to the rear enclosure with two security screws 313 to allow service access to battery pack 340 shown in FIG. 17 which is preferably a lithium ion 3.7 v 5200 mAh battery. Four screws 315 are located at the corners of the enclosure and are used to affix rear enclosure 302 to front enclosure 301.

Figure 14:
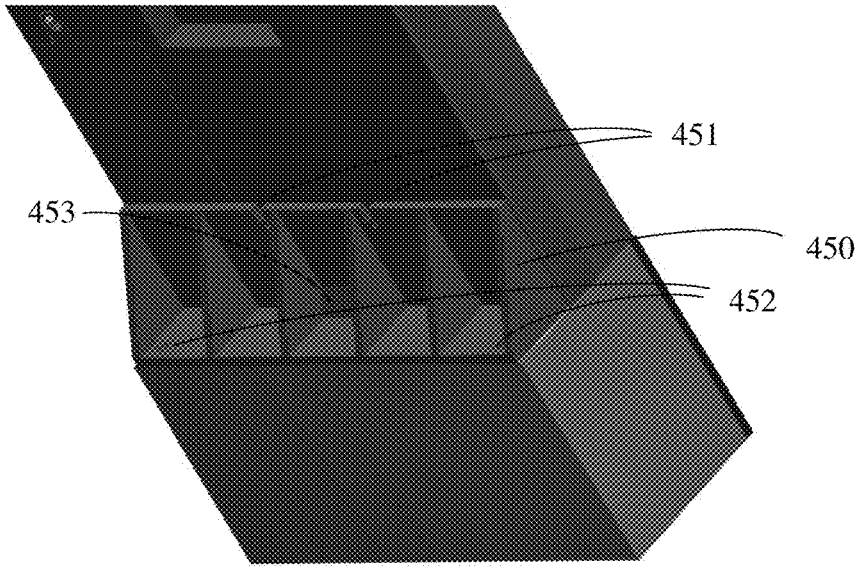
FIG. 14 is a rear view of the controller module of FIG. 12 and an alarm module fastened together with an alternative mounting bracket as shown.

As shown in FIGS. 11 and 13, alarm module 400 has a rear enclosure 401 preferably of plastic and a lid 402 preferably of metal. Lid 402 contains a hole pattern 403 above siren 410 seen in FIG. 15 to allow sound to escape with minimal acoustic attenuation. The lid 402 also contains a set of openings 404 to allow smoke exhaust to exit the alarm module. These exhaust holes are located on top of each of two smoke generators 411 and 412 seen in FIGS. 15 and 16, for example. The lid is held onto the rear alarm module enclosure 401 by four mounting security screws 405. Control signals for the smoke and alarm are fed into the alarm module through opening 414 shown in FIG. 13 which is preferably gasketed to prevent smoke from entering the inside of the bag where valuables are stored. A coupling bracket 450 as seen in FIG. 14 is placed at the corner of control module 300 and alarm module 400 and connected with mounting screws 451 into the control module and mounting screws 452 in the alarm module. A recess 453 exists under the mounting bracket 450 to allow passage of a cable harness to connect the two modules 300 and 400.

Figure 15:
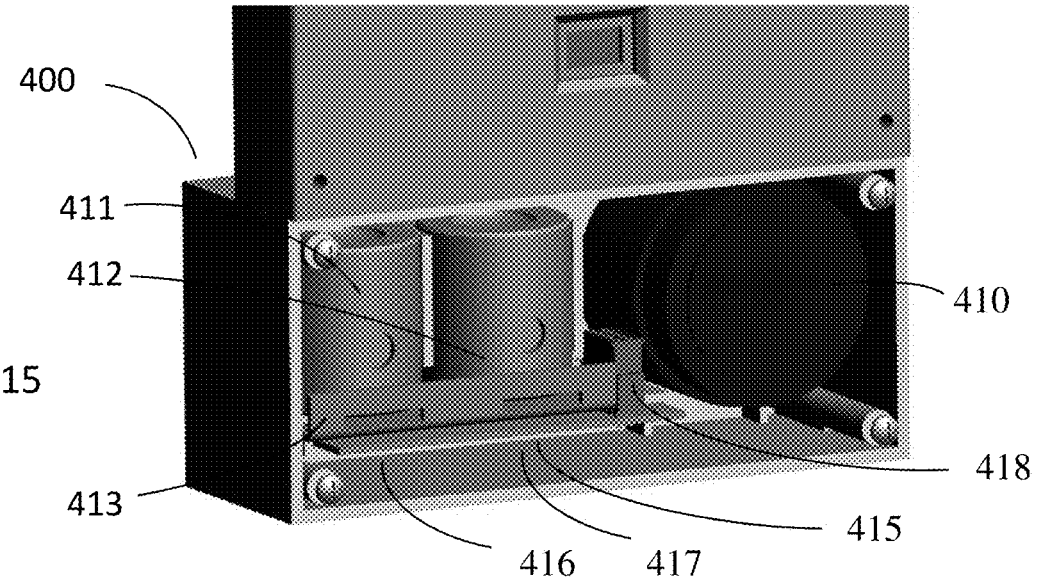
FIG. 15 shows a front view of the alarm module of FIGS. 12-14 with a front plate hidden.
Figure 16:
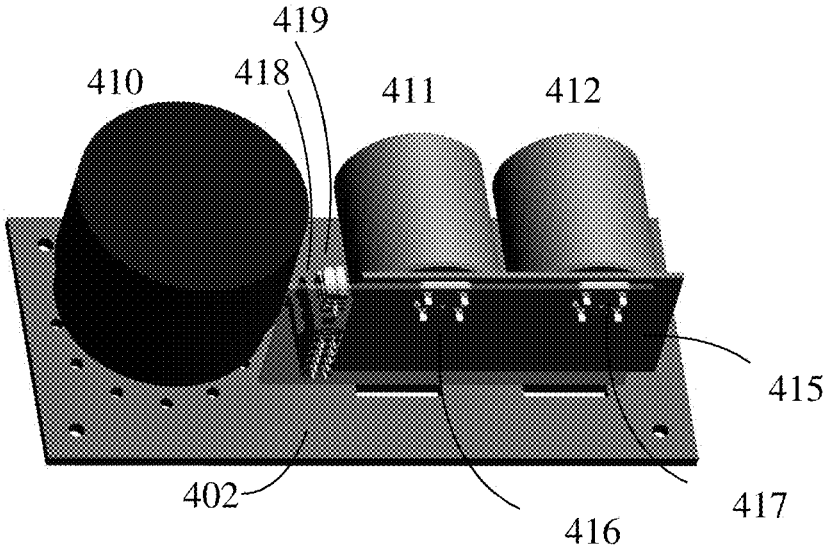
FIG. 16 is a rear view of the alarm module of FIGS. 12-14 with enclosure hidden.
Figure 17:
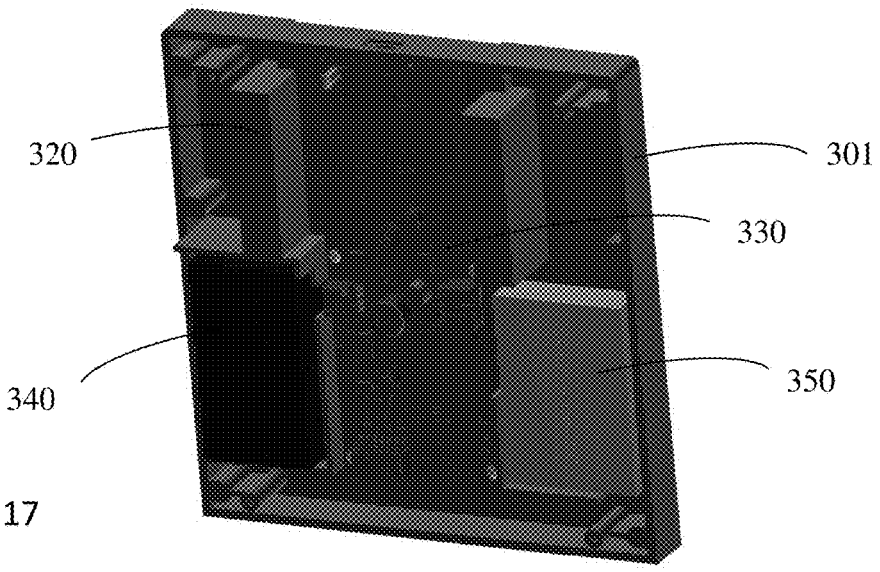
FIG. 17 is a rear view of the controller module of FIG. 12 with rear enclosure hidden.

In the presently preferred embodiment of the alarm module 400 shown in FIGS. 15 and 16, there are two smoke engines 411 and 412 each containing a fuse that is lit with ignitors 416 and 417, respectively, that sit on circuit board 415. Ignitors are preferably a heated filament type made of either nichrome, tungsten, or stainless steel that are heated by passing an electrical current from the battery pack with nominally 5 W of power to heat the filament. The fuses of the smoke candles are directed to their respective ignitors by passing through a hole in bracket 413.

Siren 410 preferably produces a 120 dBA swept sine wave output at one foot distance and is connected to power via a cable harness connector to a connector 419 located on circuit board 415.

Circuit board 415 receives power signals for both smoke generator 411 and 412 and the siren 410 through connector 418. Connector 418 may also contain a communication bus such as a UART or I2C to communicate to sensors located on circuit board 415. Such sensors may include temperature and humidity detectors that are configured to monitor environmental conditions within the alarm module for the purpose of detecting smoke deployed via a detected rise in temperature proximate to the smoke generator, or for determining if the smoke generators need to be replaced due to prolonged exposure to excessive temperature or humidity as smoke formulations may be sensitive to such environmental excesses.

Figure 3:
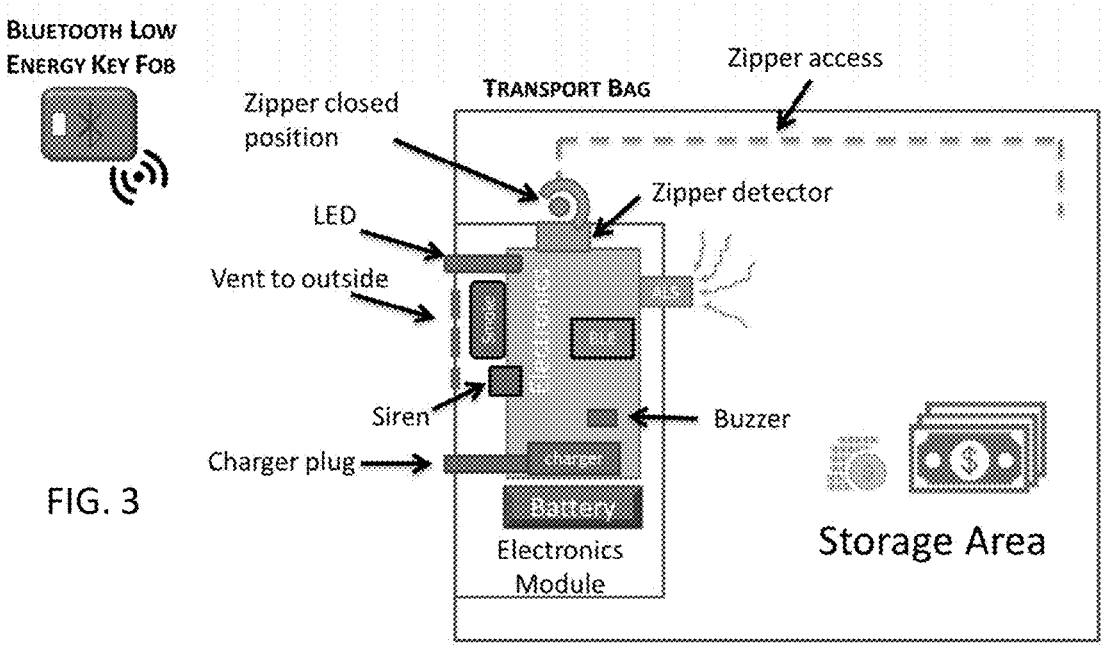
FIG. 3 illustrates details of an STB in accordance with a second embodiment of the invention.

FIG. 3 shows a second embodiment of the present invention where the alarm module 400 and the control module 300 are combined within the same housing. This design simplifies the mechanical construction of the enclosure and electrical wiring of signals as compared with the first embodiment allowing for a smaller overall module size and a reduced cost. One drawback, however, is it lacks the ability to easily change out the smoke generators after a deployment, a task much easier to accomplish with a separate alarm module.

FIG. 4 shows a third embodiment of the present invention where the alarm module 400 is located entirely outside the STB 100 and housed separately from the controller module 300. This approach uses fasteners that mechanically affix the exterior module to the interior module. These fasteners also may be employed to guide a cable harness to carry electrical signals between the two modules 300 and 400.

FIG. 5 shows a third embodiment of the present invention in which the alarm module 400 is external to the STB and connected to the internal controller module 300 by way of a hanger bracket 502 that passes underneath the zipper. The hanger bracket 502 guides a cable harness carrying electrical signals between the two modules. The embodiments of FIGS. 4 and 5 are both well suited for retrofitting existing transit bags with the disclosed security system.

Preferably, the smart transport bag uses a Bluetooth low energy radio (BLE) 318 as a primary way of monitoring proximity of the STB from an authorized guard. The guard's fob contains a radio that communicates with its paired STB periodically by advertising its identity. The STB's radio records the fob identity along with the signal strength to determine an approximate proximity of the guard to the STB.

Figure 7:
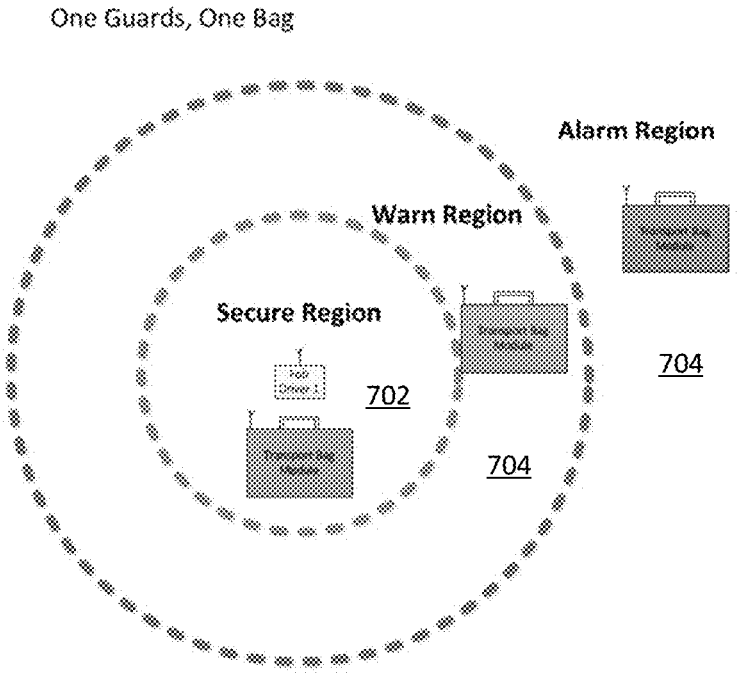
FIG. 7 illustrates aspects of STB operation when armed at various proximities with respect to one key fob where one fob is paired to the STB.

FIG. 7 shows how the measured signal strength is interpreted as being in one of three security regions of proximity when the STB is armed. A first secure region 702 is where the signal strength to the fob is measured to be very high. A second warn region 704 is where the signal strength is measured at some intermediate level. A third alarm region 704 is where the signal is weak or non-existent. The thresholds for these three regions are software adjustable and can be configured for customer usage preferences or be dynamically assigned based on patterns of usage or be trained by entering a special training mode wherein the courier is asked to walk to the boundary of each of the three regions and signal strength levels are recorded and saved. RSSI or other standard signal measurements can be used as a measure of signal strength. An example of other measurements include performing a comparison of GPS coordinates of the STB and those reported from a GPS tracker equipped smart phone. A second example of an alternative proximity measurement method is through the use of time of arrival, angle of arrival (AoA), or angle of departure (AoD) algorithms applied to BLE radios or similar approaches that produce a more precise method of distance determination and position than signal strength alone. Lastly, it is known that the use of simultaneous measurements from multiple BLE radios, which can be along the transport route, can be leveraged to form a more precise spatial position determination as summarized in a paper, An Indoor Location-Based Control System Using Bluetooth Beacons for IoT Systems written by Jun-Ho Huh and Kyungryong Seo in December 2017 (https://www.ncbi.nlm.nih.gov/pmc/articles/PMC5750778/).

Figure 8:
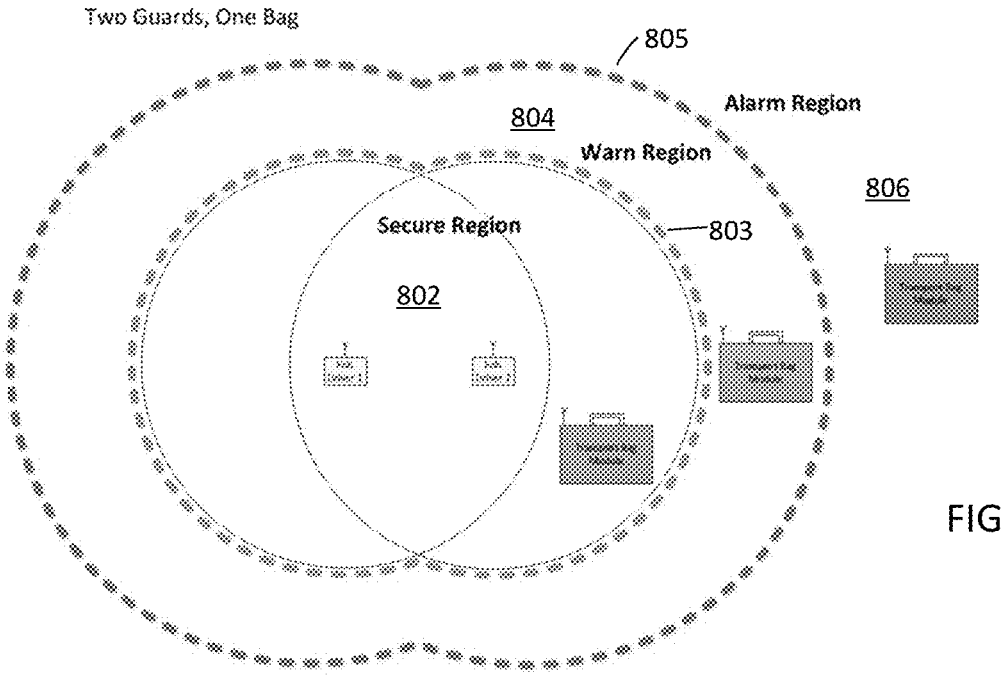
FIG. 8 illustrates STB behavior when armed at various proximities with respect to two key fobs where two fobs are paired to the STB.

At times, it may be advantageous for there to be multiple assigned couriers for one particular STB simultaneously. Each courier identified with a unique key fob that is pre-associated with the STB. In the event of two simultaneously paired key fobs, the three proximity regions are defined as shown in FIG. 8. A first secure region 802 is shown within a first dashed line 803. A second warn region 804 is shown within a second dashed line 805. A third alarm region 806 is outside the second dashed line 805. This figure demonstrates that the STB will be in one of the three security regions based on its distance from whichever key fob is closest. This behavior can be generalized for systems employing more than two key fobs.

On a daily basis, bags can be reassigned to different couriers or guards. The mechanism for assigning guards to a particular bag is to place the bag in a special pairing mode. Conventionally, to pair two radios together, there is a pairing button that is pressed. One such button could be located on the bag itself. The drawback to a pairing button on the bag is that it can be accidentally pressed, for example, by contents within the bag. A second drawback is that the guards would have the ability to re-pair the bag at their own discretion by pressing the button. A third drawback is that designing a button into the bag module, that is either mechanically protected from false activation, or secured behind an access door making it inaccessible to the guards, is costly.

Figure 9:
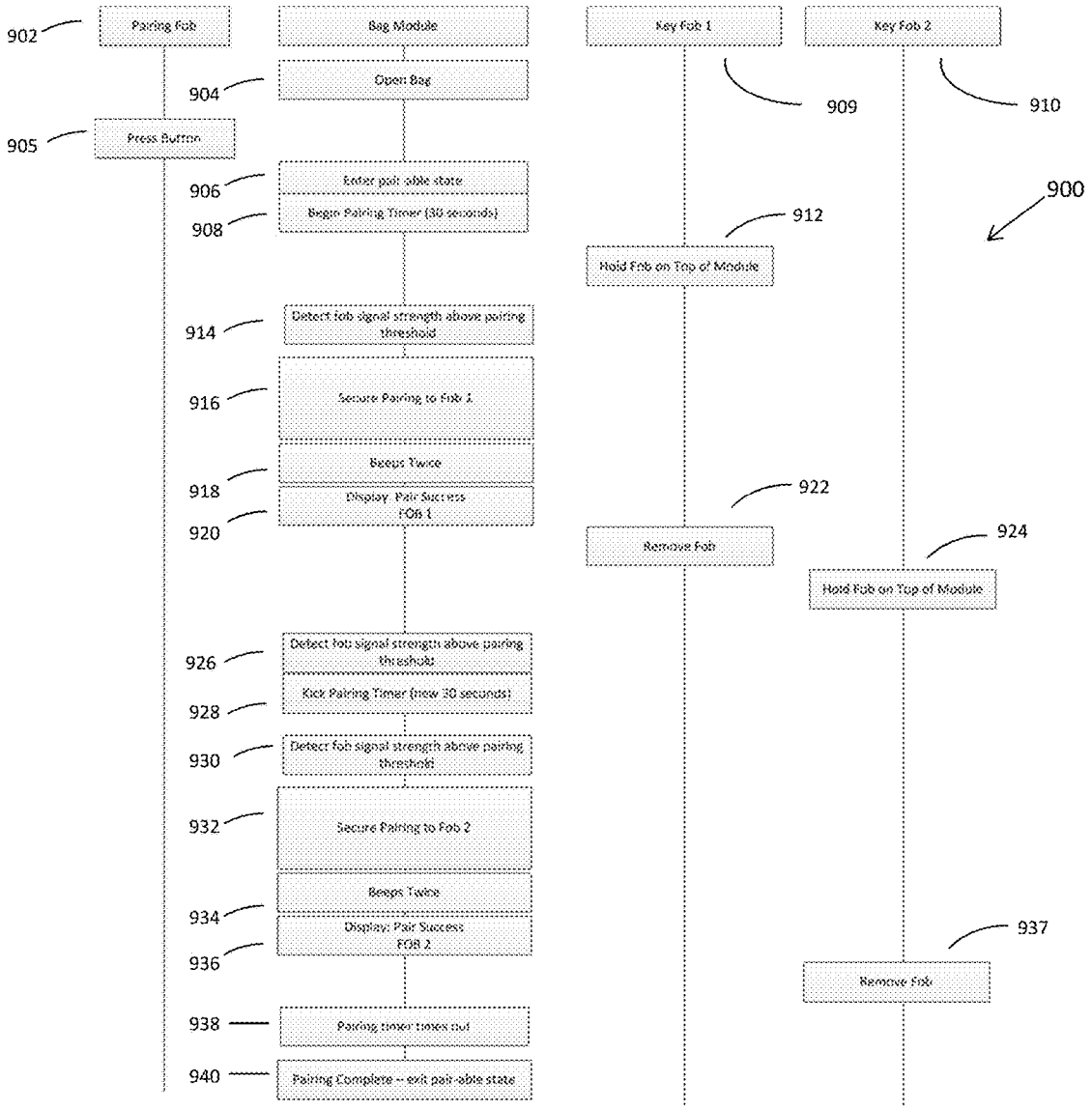
FIG. 9 demonstrates a pairing procedure to associate two key fobs to an STB in accordance with the present invention.

The present invention may advantageously employ a new pairing process 900 shown in FIG. 9 which takes advantage of the same wireless link that is used in performing proximity monitoring, such that no pairing button on the transport bag module is necessary. A privileged or supervisory pairing fob is kept in the custody of a privileged user. This user could be a supervisor located at an armored car company depot center for instance. At the start of a day, the supervisor provisions each bag to the guard or guards who will act as custodians of the bag for that day. In the embodiment of FIG. 9, the supervisor has a privileged, pairing fob which is presented for pairing with a bag module in step 902. The bag module is accessed by opening the bag in step 904. To pair the bag to a guard fob, the supervisor must first present his or her own privileged fob and press a pairing button on the fob in step 905 to place the bag in a pairing mode. Upon entering the pairing mode in step 906, the bag remains pairable for a period of time in step 908, such as 30 seconds, for example. During this time, a guard fob or fobs are selected in step 909 or steps 909 and 910, respectively, and assigned to first and second guards. Then, a first guard fob is held on top of the pairing module in step 912.

If the pairing module detects a fob signal strength above a pairing threshold in step 914, for example, for the first fob, pairing is secured to the first fob in step 916, the pairing module then provides an indication that pairing has been successful in step 918, for example, by beeping twice. In step 920, a display many also display a success message for pairing the first fob with the bag. The first fob can then be removed from the top of the pairing module in step 922. If the bag were to be paired with only a single fob, the pairing timer would time out and process 900 would end.

However, in the example shown, the second fob is held on top of the pairing module in step 924. In step 926, the pairing module detects that the fob signal strength is above the pairing threshold and the pairing timer is adjusted for a new timing period, such as 30 seconds, in step 928. In step 930, fob strength from the second fob is detected above the pairing threshold and pairing of the second fob to the bag is secured in step 932. The pairing module beeps twice in step 934 and a display that pairing has been successful occurs in step 936. In step 932, the second fob is removed. In step 938, the pairing timer times out. In step 940, pairing is complete and the pairing state is exited.

Figure 10:
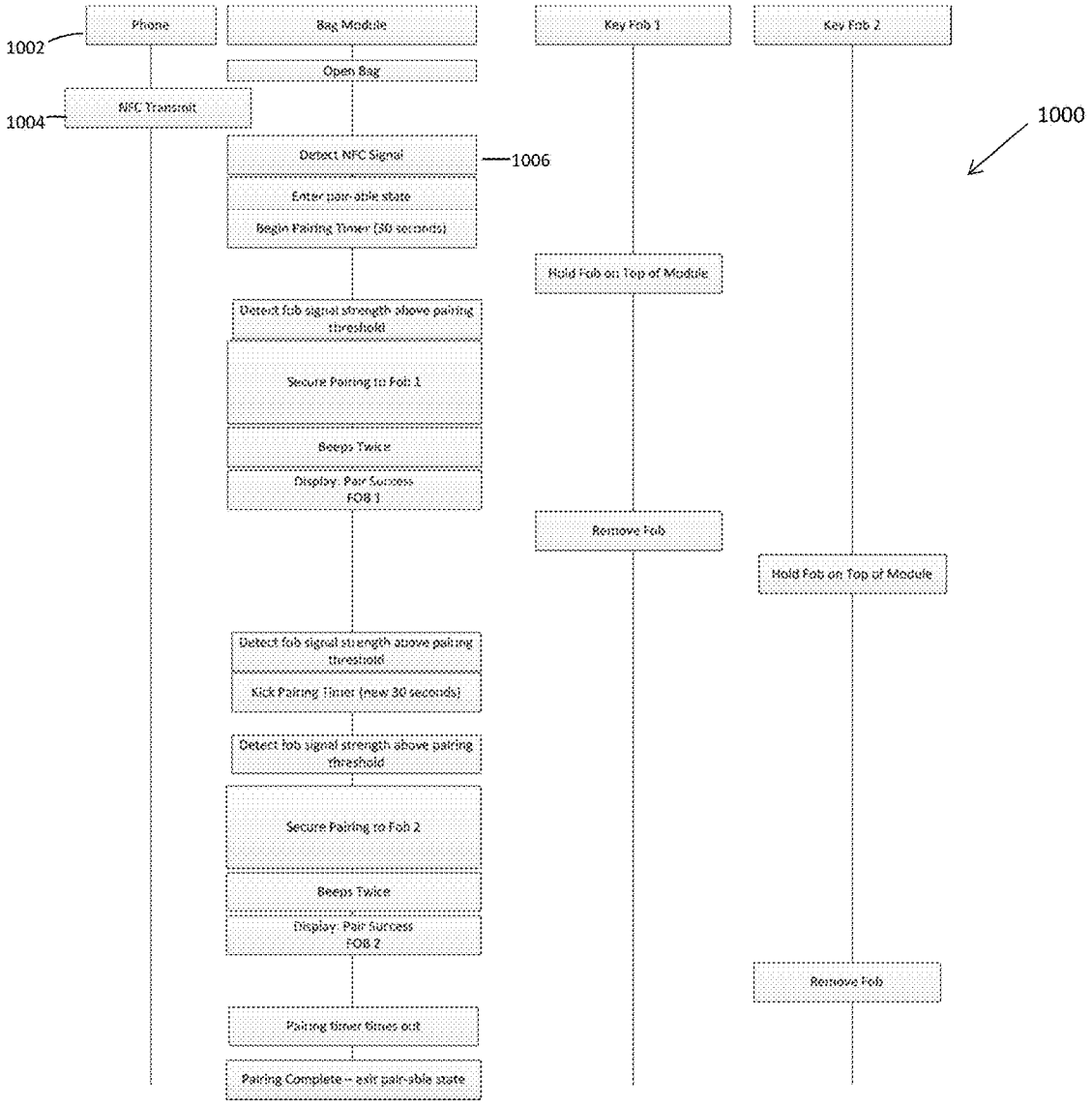
FIG. 10 demonstrates an alternate pairing procedure to associate two key fobs to an STB.

In an alternate pairing implementation, the supervisor can use a privileged secondary radio source to place the bag in pairing mode as shown in the process 1000 of FIG. 10. The secondary radio source can be purposefully in a different RF band than the primary proximity detecting radio type. For instance, a near field communication (NFC) radio source operating at 13.56 MHz can be used to enter the pairing mode. For example, a supervisor's phone can be presented in step 1002 and an NFC signal sent in step 1004. This signal is detected in step 1006. The remainder of process 1000 is similar to process 900. This method 1000 of using an out of band (OOB) radio source is more secure against hacking attempts of a hacker monitoring communications on the primary radio band, 2.4 GHz of the BLE link in this example.

In both pairing approaches described above, the bag is first paired to the supervisor's device to exchange credentials for authentication purposes. The result of proper authentication is the bag entering the pairable state where it actively looks for guard fobs at the primary proximity radio band (2.4 GHz). If guard fobs are detected to be within close proximity while in pairing mode as measured by RF signal strength (preferably within 6 inches), then the bag will proceed to pair with the guard's fob. If additional fobs need to be paired to the bag, they can continue by presenting subsequent fobs one at a time in close proximity to the bag, a process illustrated in FIGS. 9 and 10.

During daily operation, it is anticipated that the STB is issued at the beginning of a shift to a guard by a supervisor using the above described pairing procedure. Throughout the day, the guard loads the STB with valuables then zips the STB closed and turns the key to the locked position. The locking of the STB is detected by the controller and causes the STB to enter the armed state. During the armed state, the guard carries the fob in proximity to the STB to ensure the STB is in the secure region of proximity to the fob. When the guard reaches the intended destination, the key is used to unlock the STB. The controller detects the motion of the cam to the unlocked position and disarms the STB. Trips like this can continue multiple times throughout the day. At the end of the shift, the guard returns the STB to the supervisor who then plugs in the charger. Upon activating the charger, the controller erases the pairing list of all connected fobs such that the STB can be assigned to a new guard or group of guards the next day.

We claim:

1. A mobile cash transport apparatus comprising:

a receiver to receive a pairing control signal from a first supervisory fob and a pairing request signal from a first user fob;

a controller to transition the mobile cash transport apparatus to a pairing mode upon receipt of the pairing control signal;

the controller pairing the mobile cash transport apparatus with the first user fob after receiving the pairing request of the first user fob by the receiver after transition to the pairing mode.

2. The mobile cash transport apparatus of claim 1 wherein the receiver receives a pairing request signed from a second user fob while the mobile cash transport apparatus is still in the pairing mode and the controller pairs the mobile cash transport apparatus with the second user fob, as well as, the first user fob.

3. The mobile cash transport apparatus of claim 1 wherein after pairing, the controller determines a distance to the first user fob and if the distance is less than a first predetermined distance the first user fob is considered to be in a secure region, if the distance is greater than a second predetermined distance, the controller controls activation of a theft counter measure.

4. The mobile cash apparatus of claim 3 wherein the theft counter measure is release of a volume of smoke or emitting a loud warning sound to alert people in the vicinity of the mobile cash apparatus of a possible theft.

5. The mobile cash apparatus of claim 3 wherein the distance is greater than the predetermined first distance and less than the second predetermined distance, the controller activates a warning mechanism to produce a warning.

6. The mobile cash apparatus of claim 5 wherein the warning is a buzzer.

7. The mobile cash transport apparatus of claim 1 further comprising:

a cash storage container having a fastener:

a sensing mechanism to sense attempts to tamper with the mobile cash transport apparatus comprising:

a radio signal processing circuit measuring distance from a fixed or mobile radio beacon to the mobile cash transport apparatus, a detector arranged to monitor the state of the fastener, and an ambient light sensor positioned to monitor an interior of the cash storage container;

an alarm device to attract attention to an attempted tamper activity; and the controller receiving inputs from the sensing mechanism and determining if a detected attempt to temper with the mobile cash transport apparatus warrants driving the alarm device to produce a theft countermeasure.

8. The mobile cash transport apparatus of claim 7 wherein the cash storage container comprises a cash transport bag which is closed with a zipper or a drawstring and clip arrangement.

9. The mobile cash transport apparatus of claim 8 wherein a detector detects tampering with the zipper or the drawstring and clip arrangement.

10. The mobile cash transport apparatus of claim 8 wherein said detector is retrofit to a pre-existing cash transport bag lacking such a detector.

11. The mobile cash transport apparatus of claim 8 wherein the sensing mechanism electronically monitors a zipper closed position of the cash storage bag.

12. The mobile cash transport apparatus of claim 7 further comprising:

a detector to detect if the mobile cash transport apparatus is more than a predetermined distance from a transmitter.

13. The mobile cash transport apparatus of claim 12 wherein the transmitter is contained in the first user fob paired with the cash storage apparatus.

14. The mobile cash apparatus of claim 1 further comprising:

a cash storage container comprising a cash transport bag having a zipper as a closure mechanism;

a magnet attached to a bottom of a zipper body of the zipper;

a lock mechanism locking the zipper body in place when the zipper body is pulled to a fully closed position of the zipper and is locked in place;

a magnetic sensing device to detect position of the magnet and produce a position signal;

a zipper lock detector detecting when the zipper is locked; and the controller determining that the zipper is fully closed and locked in place from the position signal.

15. The mobile cash apparatus of claim 14 wherein the controller causes an output device to provide a warning signal when the zipper is not closed and locked in place within a predetermined time of being opened.

16. The mobile cash transport apparatus of claim 15 further comprising;

a sensing mechanism to sense attempts to tamper with the mobile cash transport apparatus.

17. The mobile cash transport apparatus of claim 16 wherein the locking mechanism and sensing mechanism are part of a cash bag retrofit kit.

18. The mobile cash transport apparatus of claim 15 further comprising:

an ambient light sensor positioned monitor an interior of the cash transport apparatus.

19. The mobile cash transport apparatus of claim 15 further comprising:

a smoke canister; and a siren.

* * * * *